US005582124A

United States Patent [19]

Sikora et al.

[11] Patent Number: 5,582,124

[45] Date of Patent: Dec. 10, 1996

[54] HYBRID FRAMING SYSTEM FOR VESSELS

[75] Inventors: Jerome P. Sikora; Donald P. Roseman, both of Rockville; Robert W. Michaelson, Annapolis, all of Md.

[73] Assignee: The United States of America as represented by the Secretary of the Navy, Washington, D.C.

[21] Appl. No.: 506,751

[22] Filed: Jul. 26, 1995

[51] Int. Cl.[6] ..... B63B 3/06

[52] U.S. Cl. ..... 114/74 A; 114/65 R

[58] Field of Search ..... 114/73, 74 R, 114/74 A, 77 R, 65 R, 78

[56] References Cited

U.S. PATENT DOCUMENTS

| | | | |
|---|---|---|---|
| 2,218,689 | 10/1940 | Stewart | 114/78 |
| 2,918,032 | 12/1959 | Macnaught | 114/74 R |
| 3,554,152 | 1/1971 | Campbell et al. | 114/74 R |
| 3,766,875 | 10/1973 | Baki | 114/73 |
| 4,267,789 | 5/1981 | Ivanov et al. | 114/77 R |
| 5,189,975 | 3/1993 | Zednik et al. | 114/74 R |

OTHER PUBLICATIONS

Michaelson, Robert W. and Donald P. Roseman, "Concept Design of a 40,000 DWT Advanced Double Hull Tanker," Proceedings of the Advanced (unidirectional) Double–Hull Technical Symposium, Oct. 25–26, 1994, pp. 1–15.

Melton, William, Jeffrey Beach, James Gagorik, Donald Roseman and Jerome Sikora, "Advanced Double Hull Research and Development For Naval Commercial Ship Application," Proceedings of the Annual Meeting of the Society of Naval Architects and Marine Engineers, Nov. 17–18, 1994, pp 14–1 to 14–25.

*Primary Examiner*—Sherman Basinger
*Attorney, Agent, or Firm*—Gary G. Borda

[57] ABSTRACT

The invention is directed to a hybrid framing system for providing transverse structural support to and a predetermined cargo compartment arrangement for a bulk cargo carrier vessel of the type having a longitudinal midsection for locating cargo compartments. The system includes a hull bottom and port and starboard side walls depending from the hull bottom and defining the vessel midsection, a plurality of liquid-tight transverse bulkheads attached to the bottom and side walls and defining a series of adjoining cargo compartments in the vessel midsection, and a plurality of non-liquid-tight transverse web frames, at least one of the web frames positioned between successive ones of the transverse bulkheads. The bottom and side walls each including an inner hull shell, an outer hull shell, and a plurality of longitudinal support members therebetween. A sequence of transverse support member groupings is formed for providing structural support to the vessel midsection, wherein each of the groupings includes individual support members comprising at least one of the plurality of transverse bulkheads and at least one of the plurality of transverse web frames.

15 Claims, 4 Drawing Sheets

HYBRID FRAMING SYSTEM FOR VESSELS

STATEMENT OF GOVERNMENT RIGHTS

The invention described herein may be manufactured and used by or for the Government of the United States of America for governmental purposes without the payment of any royalties thereon or therefor.

BACKGROUND OF THE INVENTION

1. Field of Invention

The present invention relates generally to a structural framing system for double hull vessels and, more particularly, to a modular, unidirectional, longitudinally framed structural system for double hulled vessels having combinations of widely spaced transverse bulkheads, longitudinal bulkheads, and/or intermediate transverse web frames arranged to obtain a desired arrangement of cargo tanks or holds.

2. Brief Description of Related Art

Conventional framing systems for single hull bulk carrier vessels consist of a complex grillage of longitudinal framing members (typically spaced at 2 to 4 foot intervals) and closely spaced transverse framing members (typically spaced at 8 to 18 foot intervals depending on the length of the vessel). The complex grillage provides all the necessary structural support to withstand external sea pressures and internal liquid cargo pressures. Longitudinal and transverse bulkheads provide cargo and watertight subdivisions but are not required for structural support. Therefore, these bulkheads may be advantageously located to provide desired size and layout of cargo compartments. Conventionally framed double hull vessels include similar grillage between inner and outer hull shells. The principal disadvantage of conventional grillage framing systems is the complexity and high construction cost that result from the large number of individual structural members and the large extent of fit up and welding required.

Unidirectional framing systems for double hulled vessels, also known as "Advanced Double Hull" (ADH) vessels, were developed to simplify construction and increase producibility by reducing the number of structural members. Unidirectional framing systems consist of inner and outer hulls having only longitudinal support members (e.g., stringers and girders) therebetween that extend between transverse bulkheads, that is, they include no transverse support members (e.g., web frames) between transverse bulkheads. Advantages of double hulled, unidirectional framing systems include simplification of structure, improved resistance to collision and grounding, greater resistance to fatigue and failure, and reduced construction time and cost. However, the longitudinal cells formed by the inner hull, outer hull, and longitudinal support members require transverse support to withstand the applied external sea loads and internal cargo loads. Accordingly, known double hull vessels employ transverse bulkheads to provide the necessary transverse support.

In conventional grillage framed vessels, the pressure loads from both the sea and cargo act on the hull shell plating and are transmitted partly to the transverse frames and partly to the longitudinal stiffeners. These members then transmit the loads to the transverse and longitudinal bulkheads. In a unidirectional double hull configuration, the lateral loads on the shell plating are transmitted via bending to the longitudinal support members and then to the transverse bulkheads through shear. However, as distance between transverse bulkheads increases (i.e., as length of cargo compartments increases) the bending moments also increase. Under primary loading (i.e., hull girder bending), the plate stiffener collapse behavior of conventional grillage framing is replaced by the cellular column behavior of unidirectional double hull framing systems. There is little experience with accounting for such different structural behavior in present design methods. To ensure adequate structural strength, the thickness of hull, bulkhead, and/or longitudinal support member plating may be increased. However, this drastically increases the weight of the vessel. In practice, plating thickness of more than about 1.5 inches is impractical for surface vessels due to the inherent weight penalty.

As previously stated, double hull vessels employ transverse bulkheads to provide necessary transverse support. The high pressure loads usually experienced by large bulk carriers, e.g., very large crude carriers (VLCC's), limit the spacing of transverse bulkheads required to support the longitudinal cells. For unidirectional framed double hull vessels, the maximum distance between transverse bulkheads based on strength requirements, and thus the corresponding maximum cargo tank length, is approximately 50 feet. Consequently, an ADH-VLCC would have many more tanks in the longitudinal direction than would be found on conventional grillage framed vessels. Decreasing the size and increasing the number of tanks, when strength considerations require a large number of transverse bulkheads, results in operational difficulties that make ADH-VLCC's potentially unattractive to tanker operators. Consequently, a principal disadvantage of unidirectional framing systems is the structurally based limitation in length between supporting transverse bulkheads that, in turn, limits maximum cargo compartment length.

Therefore, with respect to large double hull vessel design, there is a present need of a means or method for providing transverse support while reducing the number of longitudinal tanks and increasing the lengths of longitudinal tanks without detrimentally affecting the structural strength, weight or cost of the vessel.

SUMMARY OF THE INVENTION

Accordingly, it is an object of the present invention to provide an easily adaptable modular system for providing both transverse structural support and flexibility in arrangement of cargo compartments for large double hull vessel designs.

It is a further object of the present invention to provide longer cargo compartments than are presently available in unidirectional double hull tankers and bulk carriers without sacrificing structural integrity of the vessel or experiencing a weight penalty.

It is still a further object of the present invention to provide a system by which the designer may arrange cargo compartments in a desired manner through interchangeable positioning of widely spaced liquid-tight transverse bulkheads, non-liquid-tight transverse web frames, and liquid-tight longitudinal bulkheads.

Other objects and advantages of the present invention will become apparent to those skilled in the art upon a reading of the following detailed description taken in conjunction with the drawings and the claims supported thereby.

In accordance with one aspect of the present invention, these objects are met by a hybrid framing system for a bulk cargo carrier vessel that provides the required transverse structural support to the vessel and allows for flexibility in arranging cargo compartments in a longitudinal midsection of the vessel. The system includes: a double hull bottom section and port and starboard double hull side wall sections depending from the bottom section; a plurality of liquid-tight transverse bulkheads attached to the bottom section and side wall sections; and a plurality of non-liquid-tight transverse web frames, at least one of the web frames being positioned between successive ones of the transverse bulkheads. The bottom section and side wall sections, which define the longitudinal midsection of the vessel, each include an inner hull shell, an outer hull shell, and a plurality of longitudinal support members therebetween. The inner hull shell, outer hull shell and longitudinal support members produce a longitudinal cellular structure. The bottom section, sidewall sections and transverse bulkheads define a series of adjoining cargo compartments in the vessel midsection. The transverse bulkheads and transverse web frames form a sequence of transverse support member groupings that provide structural support to the longitudinal cellular structure. Each of the transverse support member groupings includes individual support members comprising at least one of the plurality of transverse bulkheads and at least one of the plurality of transverse web frames.

In a further embodiment, the present invention provides a modular system for producing a predetermined arrangement of cargo compartments in a longitudinal midsection of a double hull bulk carrier vessel. The modular system includes a plurality of adjoining structural modules that are connected in series to form a vessel midsection having a plurality of longitudinally adjacent liquid-tight cargo compartments therein. Each of the structural modules includes a hull module having forward and aft longitudinally spaced ends and a transverse support member grouping positioned between the forward and aft ends of the hull module. The transverse support member grouping provides structural support to the hull module and provide liquid-tight subdivisions that define the cargo compartments. Each hull module includes port and starboard double hull side walls having upper and lower ends, a double hull bottom spanning the lower ends of the side walls, and a deck structure spanning the upper ends of the side walls. The side walls and the bottom each including an inner shell, an outer shell, and a plurality of longitudinal support members therebetween. Each transverse support member grouping is comprised of individual support members that include a liquid-tight transverse bulkhead and at least one non-liquid-tight transverse web frame. The transverse bulkhead is attached to the forward ends of the side walls, the bottom and the deck structure. The at least one web frame is positioned between the transverse bulkhead and the aft ends of the side walls, the bottom and the deck structure.

In yet a further embodiment of the present invention, a double hull vessel having a longitudinal midsection for locating compartments is provided. The double hull vessel includes a displacement hull having a bottom, two opposite side walls and a deck structure, a plurality of liquid-tight transverse bulkheads attached to the bottom, the side walls and the deck structure and defining a series of adjoining compartments, and a plurality of non-liquid-tight transverse web frames, at least one of the web frames being positioned between successive ones of the transverse bulkheads such that a sequence of transverse support member groupings is formed for providing structural support to the vessel midsection. The bottom and opposite side walls are of unidirectional, longitudinally framed, double hull construction. The vessel midsection has a longitudinal length in feet equal to $X_A$L wherein L is less than about 55 feet and $X_A$ is an integer less than or equal to 20. Adjacent transverse bulkheads are longitudinally separated by a distance in feet equal to $X_B$L such that each compartment has a length in feet equal to $X_B$L wherein $x_B$ is an integer between one and five, the value of which may vary among cargo compartments. Each of the transverse support member groupings comprises individual support members including one of the plurality of transverse bulkheads and at least one of the plurality of transverse web frames. Individual support members in each grouping are separated by a distance in feet equal to L.

BRIEF DESCRIPTION OF THE DRAWINGS

The foregoing objects and other advantages of the present invention will be more fully understood by reference to the following description taken in conjunction with the accompanying drawings wherein like reference numerals refer to like or corresponding elements throughout and wherein.

DETAILED DESCRIPTION OF THE PREFERRED EMBODIMENT

Figure 1:
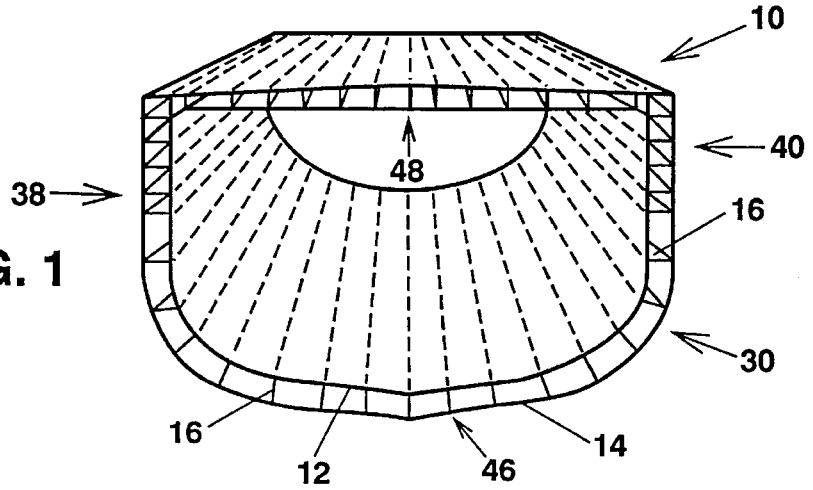
FIG. 1 is a perspective view of an ADH hull module in accordance with the present invention.
Figure 2A:
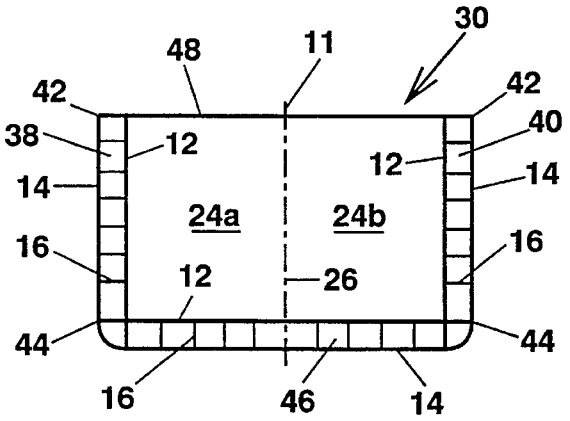
FIG. 2A is a cross sectional view taken along line A—A of FIG. 2B.
Figure 2B:
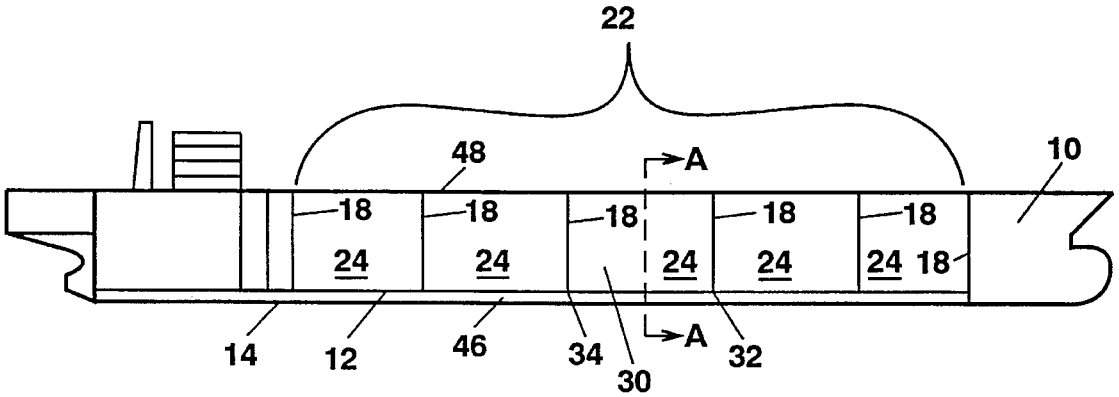
FIG. 2B is a side view of a vessel in accordance with the present invention.

Referring now to the drawings, and particularly to FIGS. 1 and 2, the hybrid framing system of the present invention is presented. The hybrid framing system is appropriate for constructing the load bearing structural frame and cargo compartments of large, double hulled, dry and liquid bulk carrier vessels, such as for example, oceangoing oil tankers and VLCC's. The hybrid framing system entails arranging a plurality of modular framing systems employing an "advanced double hull" design to obtain a predetermined arrangement of cargo tanks or cargo holds while ensuring the structural strength required to withstand external sea loads and internal cargo loads acting on the vessel hull. The present invention provides an easily adaptable system for the structural design of large double hull vessels by the interchangeable positioning of widely spaced transverse liquid-tight bulkheads and transverse non-liquid-tight web frames in combination with a longitudinal cellular hull structure. Advanced double hull vessels are described in two papers by the present inventors: (1) Michaelson, Robert W and Donald P. Roseman, Concept Design of a 40,000 DWT Advanced Double Hull Tanker," Proceedings of the Advanced (unidirectional) Double-Hull Technical Symposium, Oct. 25–26, 1994, pp. 1–15; and (2) Melton, William, Jeffrey Beach, James Gagorik, Donald Roseman and Jerome Sikora, "Advanced Double Hull Research and Development for Naval Commercial Ship Application," Proceedings of the Annual Meeting of the Society of Naval Architects and Marine Engineers, Nov. 17–18, 1994, pp. 14-1 to 14-25. These two papers are incorporated herein by reference.

Referring to FIGS. 1–6, the individual structural elements of the hybrid framing system for double hull bulk carrier vessel 10 includes: (1) a longitudinal cellular structure defined by an inner hull shell 12, an outer hull shell 14 and a plurality of unidirectional longitudinal support members 16 therebetween for providing the basic double hull of midsection 22 of vessel 10; (2) a plurality of transverse liquid-tight bulkheads 18 for providing transverse division in midsection 22 for the cargo compartments and transverse support for the longitudinal cellular structure; and (3) a plurality of transverse non-liquid-tight web frames 20 at least one of which is located between succeeding transverse liquid-tight bulkheads 18 for providing transverse support for the longitudinal cellular structure. Transverse non-liquid-tight web frames 20 do not subdivide cargo compartments 24. Individual structural elements are arranged in a predetermined fashion to produce midsection 22 containing cargo compartments 24. Preferably, the entire midsection 22 is constructed in accordance with the present invention. However, it is also possible to have only sections of midsection 22 arranged in accordance with the present invention with compartments not in accordance with the present invention placed intermittently between series of compartments 24 built in accordance with the present invention. Furthermore, compartments such as slop tanks, storage rooms, fuel tanks, engine rooms, etc., may be located forward and/or aft of midsection 22.

The longitudinal cells formed by inner hull shell 12, outer hull shell 14, and longitudinal support members 16 require transverse support to withstand applied external sea loads and internal cargo loads. As stated earlier, prior art ADH vessels include no transverse support members between transverse bulkheads. Consequently, prior art ADH vessels employ only transverse bulkheads to provide the necessary transverse support. The lateral loads on the shell plating are transmitted via bending to the longitudinal support members and then to the transverse bulkheads through shear. However, as distance between transverse bulkheads increases (i.e., as desired length of cargo compartments increases) the bending moments also increase. In prior art designs, the high pressure loads normally experienced by large ADH bulk carriers limit the spacing of transverse bulkheads required to support the longitudinal cells. The present invention enables increased cargo compartment size and design flexibility while supplying the additional transverse structural support required by the longitudinal cellular structure necessary to withstand applied loads. Liquid-fight bulkheads 18 and non-liquid-tight web frames 20 replace the transverse bulkheads of prior art designs as the only transverse support members providing the transverse structural support necessary to withstand external sea loads and internal cargo loads on the longitudinal cellular structures. Thus the modular system of the present invention provides both transverse structural support and flexibility in arrangement of cargo compartments for large double hull vessel designs.

Depending upon the size and strength requirements of vessel 10, particularly of midsection 22, transverse web frames 20 may be positioned completely between inner hull shell 12 and outer hull shell 14, or completely within cargo compartment 24, or a combination of between inner and outer hull shells 12, 14 and within cargo compartment 24. Additionally, one or more longitudinal liquid-tight bulkheads 26 extending between adjacent transverse bulkheads 18 may be added to provide lateral subdivisions in midsection 22 to increase the number of cargo compartments 24 and to increase the structural strength of midsection 22.

The individual structural elements of the framing system may be employed as a modular system for providing a predetermined arrangement of cargo compartments 24 in vessel 10. The modular system includes a plurality of adjoining structural modules 28 connected in series for forming midsection 22 and for forming longitudinally adjacent liquid-tight cargo compartments 24 therein. Each structural module 28 includes a hull module 30 having forward and aft longitudinally spaced ends 32 and 34 and a transverse support member grouping 36 rigidly attached to hull module 30 between forward and aft ends 32 and 34 for providing structural support to hull module 30.

Each hull module 30 includes port and starboard double hull side walls 38 and 40 having upper and lower ends 42 and 44, a double hull bottom 46 rigidly attached to and spanning lower ends 44 of side walls 38 and 40, and a deck structure 48 rigidly attached to and spanning upper ends 42 of side walls 38 and 40. Port side wall 38, starboard sidewall 40, and bottom 46 are composed of inner shell 12, outer shell 14, and plurality of longitudinal support members 16 therebetween.

The individual support members of transverse support member grouping 36 include a liquid-tight transverse bulkhead 18 rigidly attached to hull module 30 at forward end 32 and at least one non-liquid-tight transverse web frame 20 positioned between transverse bulkhead 18 and aft end 34 of hull module 30. Transverse bulkhead 18 is attached to forward ends 32 of side walls 38 and 40, bottom 46 and deck structure 48. Side walls 38 and 40, bottom 46, deck structure 48 and transverse bulkhead 18 define a cargo space within structural module 28. Structural module 28 may further include one or more liquid-tight longitudinal bulkheads 26 extending between forward and aft ends 32 and 34 and attached to transverse bulkhead 18 and bottom 46.

Figure 7A:
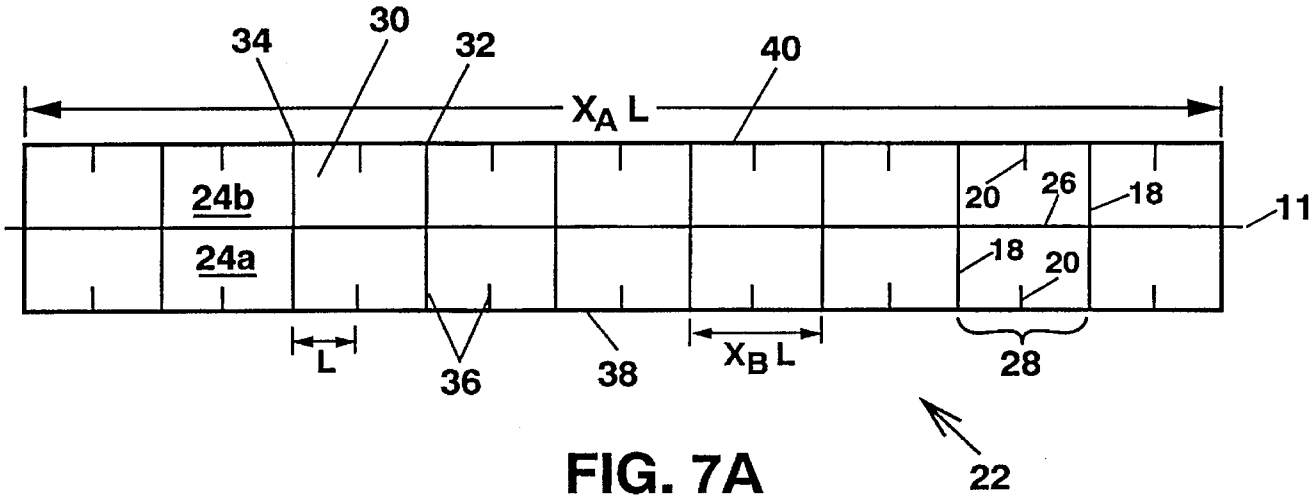
FIGS. 7A and 7B are schematic views showing alternative arrangements of transverse bulkheads, longitudinal bulkheads and transverse web frames in accordance with the present invention.
Figure 7B:
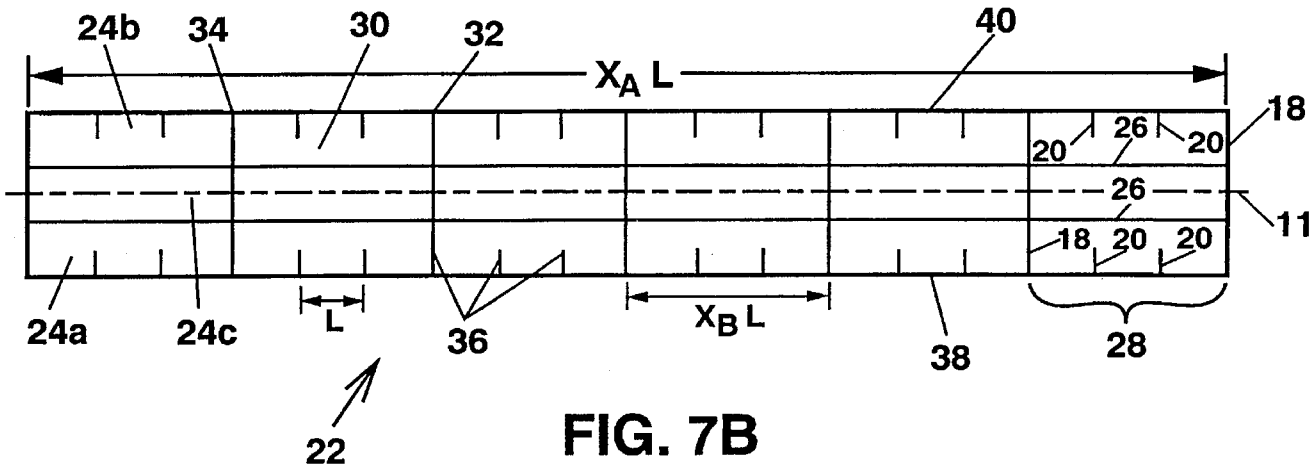

Referring to FIGS. 7A and 7B, a predetermined number of structural modules 28 are connected in series to form midsection 22 (or portions thereof built in accordance with the present invention) having a corresponding number of cargo compartments 24 therein (assuming no longitudinal bulkheads 26). Where longitudinal bulkheads 26 are present, cargo compartments 24 are divided into at least two laterally adjacent liquid-tight cargo compartments **24*a* and 24*b*. Hull modules 30 are arranged in sequence such that forward end 32 of one hull module 30 is connected to aft end 34 of the preceding hull module 30 to form a plurality of cargo compartments 24. The aft most hull module will require an additional transverse bulkhead 18 attached to its aft end 34 to close the aft most cargo compartment. In a preferred embodiment, midsection 22 has a total longitudinal length in feet equal to $X_A L$ where L is less than about 55 feet and $X_A$ is a number, preferably an integer, less than or equal to 20. In such a case, each structural module 28 has a longitudinal length in feet equal to $X_B L$ where $X_B$ is a number, preferably an integer, between 1 and 5. The value of $X_B$ may vary among structural modules. Thus, individual support members in each transverse support member grouping 36 are separated by a distance in feet equal to L. Consequently, there is either a transverse bulkhead 18 or a transverse web frame 20 every 55 feet or less from the forward most end to the aft most end of midsection 22 (or portions thereof built in accordance with the present invention). This arrangement assures adequate transverse structural support to midsection 22 without paying the weight penalty associated with ever increasing plate thickness. Moreover, since the lengths of cargo compartments 24 are determined by the spacing between liquid-tight transverse bulkheads 18, with non-liquid-tight web frames 20 allowing cargo to move freely between adjacent transverse bulkheads 18, the length of cargo compartments 24** may be easily varied.

Based on structural requirements and desired size and locations of compartments 24, the arrangement in which web frame 20 is attached to and positioned with respect to a corresponding hull module 30 may vary among designs. In a small vessel, web frame 20 may be attached to and located completely between inner shell 12 and outer shell 14. As hull size and associated hull loads increase, more transverse support may be required. Thus, a larger web frame 20 may be located completely within cargo compartment 24. That is, web frame 20 may be attached to and project into the cargo space from one or more of the following: double hull bottom 46, port double hull side wall 38, starboard double hull side wall 40, deck structure 46, and one or more of longitudinal bulkheads 26. For maximum transverse structural support and/or for very large vessels (e.g., VLCC's), a combination of the two preceding arrangements may be employed.

In a preferred embodiment, the hybrid framing system of the present invention provides both a predetermined arrangement of cargo compartments 24 in midsection 22 of vessel 10 and transverse structural support to midsection 22. Longitudinal midsection 22 is symmetric about a longitudinal centerline 11 of vessel 10. Midsection 22 includes a double hull bottom section 46, port and starboard double hull side wall sections 38 and 40 both attached to bottom section 46, a plurality of liquid-tight transverse bulkheads 18 attached to bottom section 46 and side wall sections 38 and 40, and a plurality of non-liquid-tight transverse web frames 20 attached to bottom section 46 and side wall sections 38 and 40. Although the spacing between transverse supports (transverse bulkheads 18 and transverse web frames 20) may be spaced in any desired fashion sufficient to provide the required structural support, in a more preferred embodiment bottom section 46 and side wall sections 38 and 40 have a longitudinal length in feet equal to $X_A L$ wherein L is less than about 55 feet and $X_A$ is an integer less than or equal to 20. Bottom section 46 and side wall sections 38 and 40 each including an inner hull shell 12, an outer hull shell 14, and a plurality of longitudinal support members 16 therebetween. Inner hull shell 12, outer hull shell 14, and longitudinal support members 16 create a longitudinal cellular structure. Liquid-tight transverse bulkheads 18 define a series of adjoining liquid-tight cargo compartments 24. In the more preferred embodiment referred to above, transverse bulkheads 18 are longitudinally separated by a distance in feet equal to by $X_B L$ such that each cargo compartment 24 has a length in feet equal to $X_B L$ and wherein $X_B$ is an integer between 1 and 5 the value of which may vary among cargo compartments. Each cargo compartment 24 defines a cargo space therein. At least one web frame 20 is positioned between successive transverse bulkheads 18 such that a sequence of transverse support member groupings 36 is formed. Transverse support member groupings 36 provides structural support to the longitudinal cellular structure. Each support member groupings 36 includes individual support members that include at least one transverse bulkhead 18 and at least one transverse web frame 20. Moreover, in the more preferred embodiment referred to above, support members in each transverse support member grouping 36 are separated by a distance in feet equal to L.

Figure 3:
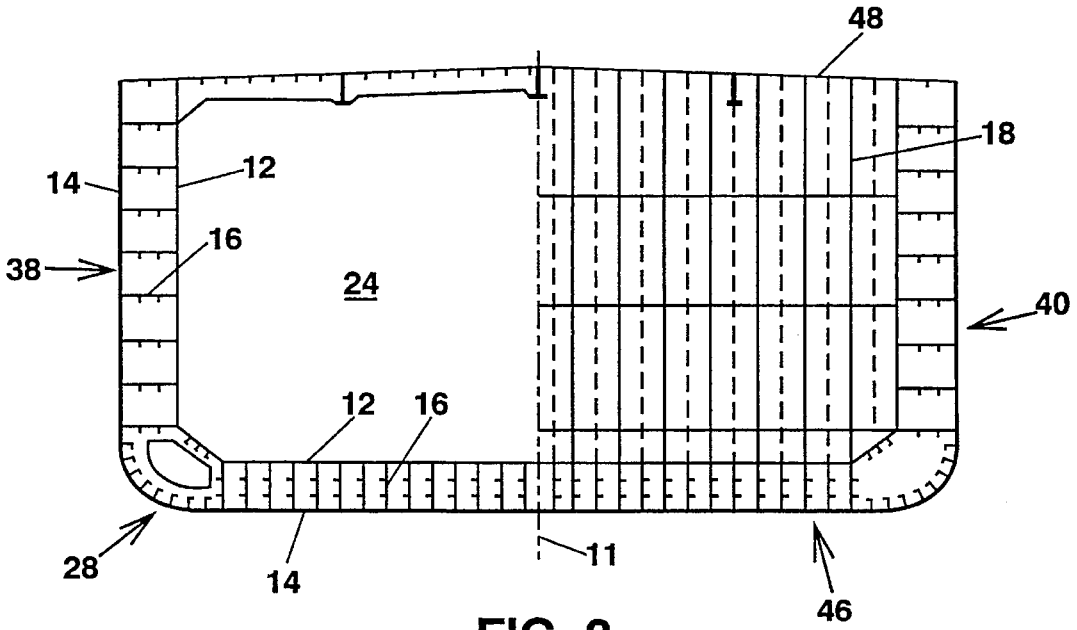
FIG. 3 is a cross sectional view of one embodiment of the present invention showing a structural module having a full-beam cargo tank (i.e., no longitudinal bulkhead), the right hand side of FIG. 3 is a section in way of a transverse bulkhead while the left hand side shows the cargo space.

Additionally, the present framing system may further include one or more liquid-tight longitudinal bulkheads 26 in one or more of cargo compartments 24. Longitudinal bulkheads 26 extends between pairs of adjacent transverse bulkheads 18 that define cargo compartments 24. One or more longitudinal bulkheads 26 are attached to bottom section 46 and adjacent transverse bulkheads 18 in cargo compartment 24 and, thus, divide cargo compartments 24 into two or more laterally adjacent liquid-tight cargo compartments (e.g., port compartments **24*a* and starboard compartment 24*b*). Transverse bulkheads 18 and longitudinal bulkheads 26 may be of any well known corrugated construction. Alternatively, transverse bulkheads 18 and longitudinal bulkheads 26 may be fabricated from a single metal plate or from two or more adjoining metal plates. Preferably, as shown in FIGS. 3–6, transverse bulkheads 18 and longitudinal bulkheads 26 are constructed of an individual plate member 50 having attached thereto a plurality of vertical and horizontal support members 51 and 52**.

Where no longitudinal bulkheads 26 are present, as shown in FIG. 3, full-beam cargo compartments 24 will extend the entire transverse breadth of vessel 10 from inner hull shell 12 of port sidewall 38 to inner hull shell 12 of starboard sidewall 40. In such a case, web frames 20 may be rigidly attached to vessel 10 by either (a) attaching web frame 20 to inner hull shell 12 and outer hull shell 14 such that web frame 20 is positioned between the inner and outer hull shells, (b) attaching web frame 20 to at least one of bottom section 46, port side wall section 38 and starboard side wall section 40 such that web frame 20 projects into cargo compartment 24, or (c) a combination of (a) and (b).

Figure 4:
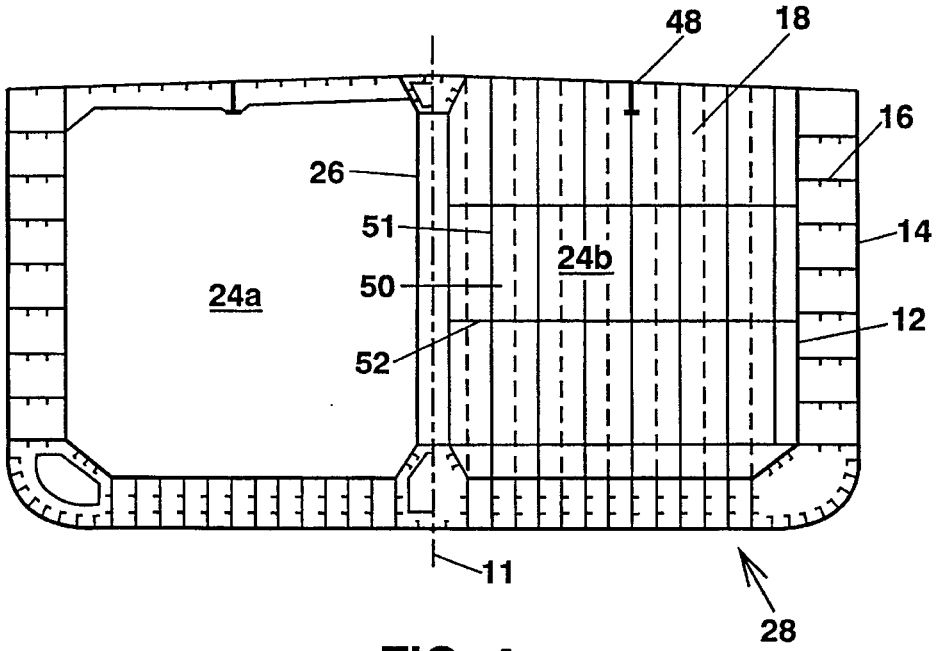
FIG. 4 is a cross sectional view of an alternative embodiment of the present invention showing a structural module having a centerline longitudinal bulkhead, the right hand side of FIG. 4 is a section in way of a transverse bulkhead while the left hand side shows the cargo space.

Alternatively, as shown in FIG. 4, cargo compartment 24 may include one liquid-tight longitudinal bulkhead 26 positioned along vessel centerline 11 to form port and starboard cargo compartments **24*a* and 24*b*. In such a case, web frames 20 may be rigidly attached to vessel 10 by either (a) attaching web frame 20 to inner hull shell 12 and outer hull shell 14 such that web frame 20 is positioned between inner and outer hull shells, (b) attaching web frame 20 to at least one of bottom section 46, port side wall section 38, starboard side wall section 40, and longitudinal bulkhead 26 in each of cargo compartments 24*a* and 24*b* such that web frame 20 projects into cargo compartments 24*a* and 24*b***, or (c) a combination of (a) and (b).

Figure 5:
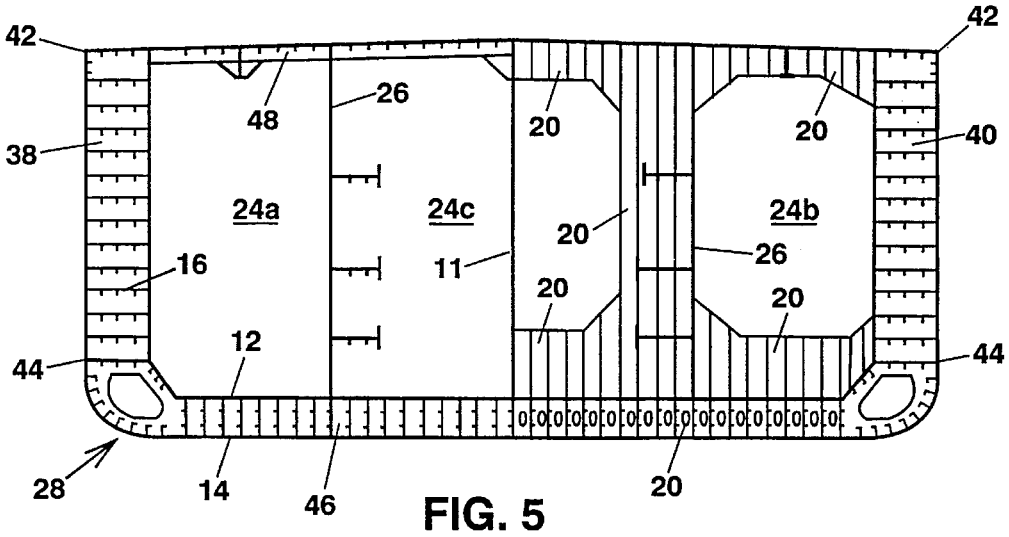
FIG. 5 is a cross sectional view of an alternative embodiment of the present invention showing a structural module having two longitudinal bulkheads creating a central cargo compartment of width W and port and starboard cargo compartments of widths W/2, the right hand side of FIG. 5 is a section in way of a transverse web frames while the left hand side shows the cargo space.
Figure 6:
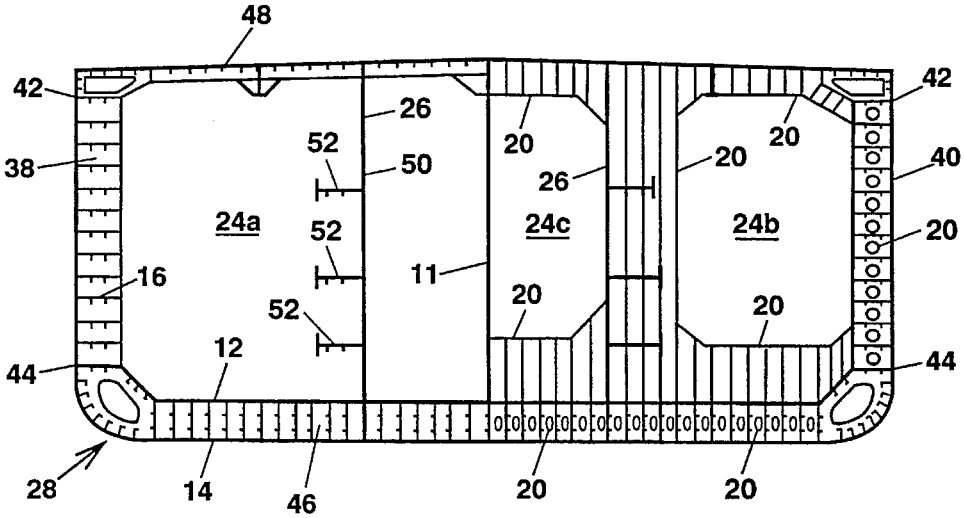
FIG. 6 is a cross sectional view of an alternative embodiment of the present invention showing a structural module having two longitudinal bulkheads creating B cargo compartments of equal transverse dimension, the right hand side of FIG. 6 is a section in way of a transverse web frames while the left hand side shows the cargo space.

Alternatively, as shown in FIGS. 5 and 6, cargo compartment 24 may include two liquid-tight longitudinal bulkheads 26 positioned symmetrically about vessel centerline 11 to form port, starboard and central cargo compartments **24*a*, 24*b* and 24*c*. In this arrangement, central cargo compartment 24*c* has a width equal to W and port and starboard cargo compartments 24*a* and 24*b* have widths equal to between W/2 and W. In such a case, web frames 20 may be rigidly attached to vessel 10 by either (a) attaching web frame 20 to inner hull shell 12 and outer hull shell 14 such that web frame 20 is positioned between inner and outer hull shells, (b) attaching web frame 20 to at least one of bottom section 46, port side wall section 38, starboard side wall section 40, and longitudinal bulkhead 26 in each of cargo compartments 24***a* and 24*b* such that web frame 20 projects into port and starboard cargo compartments 24*a* and 24*b*, (c) attaching web frame 20 to at least one of bottom section 46 and longitudinal bulkheads 26 in central cargo compartments 24*c* such that web frame 20 projects into cargo compartment 24*c*, or (d) a combination of (a), (b) and (c).

The individual structural elements of the present invention may be connected by any suitable method for constructing ship hulls, such as welding or bolting. Exemplary welding processes suitable for the present invention include electro-gas welding, electroslag welding, flux cored arc welding, and submerged arc welding. Such methods are well known to the Naval Architect of ordinary skill and will not be described in detail herein.

The present invention provides a means for producing a double hull vessel 10 having a desired arrangement of cargo compartments 24 in its midsection 22 (or portions thereof built in accordance with the present invention) and adequate strength to withstand applied loads. In a preferred embodiment, midsection 22 has a longitudinal length in feet equal to $X_A L$ wherein L is less than about 55 feet and $X_A$ is an integer less than or equal to 20. Double hull vessel 10 includes bottom 46, two opposite side walls 38 and 40, and a deck structure 48. Bottom 46 and opposite side walls 38 and 40 are of unidirectional, longitudinally framed, double hull construction.

Desired arrangement of cargo compartments 24 and required structural strength are provided by liquid-tight transverse bulkheads 18 attached to bottom 46, side walls 38 and 40 and deck structure 48, by non-liquid-tight transverse web frames 20, at least one of which is positioned between successive transverse bulkheads 18 to form a sequence of transverse support member groupings 36, and optionally by liquid-tight longitudinal bulkheads 26 extending between pairs of successive transverse bulkheads 18. Transverse bulkheads 18 define a series of adjoining compartments 24 (or if one or more longitudinal bulkheads are included, a series of adjoining compartments 24 each including two or more laterally adjacent compartments), each having a space therein. In the preferred embodiment, adjacent transverse bulkheads 18 are longitudinally separated by a distance in feet equal to $X_B L$ such that each compartment 24 has a length in feet equal to $X_B L$ wherein $X_B$ is an integer between one and five the value of which may vary among cargo compartments. In the preferred embodiment, individual transverse support members (transverse bulkheads 18 and transverse web frames 20) in each transverse support member groupings 36 are separated by a distance in feet equal to L.

For example, assume a VLCC vessel having an 825 foot long cargo carrying midsection containing cargo compartments of uniform length is desired. Further assume that individual structural members are conventional stiffened plate structures constructed of ordinary mild steel having a thickness of less than 1.5 inches. Known unidirectional, longitudinally framed, double hull vessel designs, designed to have the minimum number of cargo compartments (i.e., longest possible compartments) while providing required structural strength, would likely have a spacing between transverse bulkheads of 51.56 feet to produce a midsection having 16 cargo compartments (assuming full beam cargo tanks with no longitudinal bulkheads) each 51.56 feet long. In this example L=51.56 feet requiring approximately the maximum permissible plate thickness.

On the other hand, the present invention would provide an exemplary vessel having one non-liquid-tight web frame positioned midway between each successive liquid-tight transverse bulkhead to produce a midsection having 9 cargo compartments (assuming no longitudinal bulkheads) each 91.67 feet long. In this example L=45.833 feet, thus, plate thickness may be reduced while maintaining strength equivalent to the conventional design. Alternatively, two web frames could be positioned equidistantly between successive transverse bulkheads to produce a midsection having 6 cargo compartments (assuming no longitudinal bulkheads) each 137.50 feet long. In this example L=45.833 feet, thus, plate thickness may be reduced while maintaining strength equivalent to the conventional design. Using the present invention, the designer may arrange cargo compartments in a desired manner through interchangeable positioning of widely spaced liquid-tight transverse bulkheads, non-liquid-tight transverse web frames, and liquid-tight longitudinal bulkheads.

The advantages of the present invention are numerous. The framing system of the present invention allows cargo compartments longer than the allowable unsupported span of longitudinal framing in advanced double hull designs. Accordingly, cargo compartment of increased length may be employed while retaining the advantages of advanced double hull construction. Transverse support is provided while reducing the number of longitudinal tanks and increasing the lengths of longitudinal tanks without detrimentally affecting the strength, weight or cost of the vessel. Therefore, the present invention allows flexibility in sizing and locating cargo compartments and provides required hull strength to the cargo carrying midsection. Due to reduced number of structural members and linear feet of weld with the present invention, producibility relative to conventional tanker designs is improved.

The present invention and many of its attendant advantages will be understood from the foregoing description and it will be apparent to those skilled in the art to which the invention relates that various modifications may be made in the form, construction and arrangement of the elements of the invention described herein without departing from the spirit and scope of the invention or sacrificing all of its material advantages. The forms of the present invention herein described are not intended to be limiting but are merely preferred or exemplary embodiments thereof.

What is claimed is:

1. A hybrid framing system for an Advanced Double Hull (ADH) bulk cargo carrier vessel, said hybrid framing system providing required transverse structural support to the vessel necessary to withstand external sea loads and internal cargo loads, providing cargo compartments having increased longitudinal length in an ADH configuration, and allowing flexibility in arranging said cargo compartments in a longitudinal midsection of the vessel, said hybrid framing system comprising:

a unidirectional double hull bottom section and port and starboard unidirectional double hull side wall sections depending from said bottom section, said bottom section and side wall sections defining said longitudinal midsection of the vessel, each of said bottom section and side wall sections including an inner hull shell, an outer hull shell, and a plurality of longitudinal support members therebetween, said plurality of longitudinal support members extending continuously between and attached to said inner and outer hull shells, said inner hull shell, outer hull shell and longitudinal support members defining a longitudinal cellular structure;

a plurality of liquid-tight transverse bulkheads attached to said bottom section and side wall sections and defining a series of adjoining cargo compartments, each of said cargo compartments having a cargo space therein; and a plurality of non-liquid-tight transverse web frames, at least one of said web frames positioned between successive ones of said transverse bulkheads such that a sequence of transverse support member groupings is formed for providing said transverse structural support to said longitudinal cellular structure, wherein each of said transverse support member groupings includes individual support members comprising at least one of said plurality of transverse bulkheads and at least one of said plurality of transverse web frames whereby said transverse support member groupings are the only transverse support members providing said transverse structural support necessary to withstand external sea loads and internal cargo loads to said longitudinal cellular structure, and further wherein successive individual support members in said sequence of transverse support member groupings are equidistantly separated by a distance in feet equal to L wherein L is less than about 55 feet.

2. A hybrid framing system as in claim 1, wherein said bottom and side wall sections have a longitudinal length in feet equal to $x_1L$ wherein $x_1$ is an integer less than or equal to 20.

3. A hybrid framing system as in claim 2, wherein successive transverse bulkheads are longitudinally separated by a distance in feet equal to $x_2L$ such that each cargo compartment has a length in feet equal to $x_2L$ and wherein $x_2$ is an integer between 1 and 5 the value of which may vary among cargo compartments.

4. A hybrid framing system as in claim 3, wherein each of said plurality of transverse bulkheads comprises an individual plate member having attached thereto a plurality of vertical and horizontal support members.

5. A hybrid framing system as in claim 3, wherein each of said at least one web frames is attached to said longitudinal cellular structure and positioned with respect to said longitudinal cellular structure in an arrangement chosen from the group consisting of (a) said web frame being attached to and located between said inner hull shell and said outer hull shell, (b) said web frame being attached to and projecting into said cargo space from said inner hull shell of at least one of said bottom section, said port side wall section and said starboard side wall section, and (c) a combination thereof.

6. A hybrid framing system as in claim 3, wherein one of said plurality of web frames is positioned between successive transverse bulkheads, said one of said plurality of web frames being located midway between successive transverse bulkheads.

7. A hybrid framing system as in claim 3, wherein two of said plurality of web frames are positioned between successive transverse bulkheads, said two of said plurality of web frames being located equidistantly between successive transverse bulkheads.

8. A hybrid framing system as in claim 3, further comprising at least one liquid-tight longitudinal bulkhead extending between each successive pair of transverse bulkheads and attached thereto, said at least one longitudinal bulkhead dividing said series of adjoining cargo compartments into a series of at least two laterally adjacent cargo compartments between each pair of successive transverse bulkheads.

9. A hybrid framing system as in claim 8, wherein each of said at least one longitudinal bulkheads comprises an individual plate member having attached thereto a plurality of vertical and horizontal support members.

10. A hybrid framing system as in claim 8, further comprising one liquid-tight longitudinal bulkhead extending between each successive pair of transverse bulkheads and positioned along a longitudinal centerline of the vessel wherein a plurality of port and starboard cargo compartments are formed, and wherein each web frame is attached and positioned in a arrangement chosen from the group consisting of (a) said web frame being attached to and located between said inner hull shell and said outer hull shell, (b) said web frame being attached to and projecting into said cargo space from at least a portion of said inner hull shell and at least a portion of said longitudinal bulkhead in each of said port and starboard cargo compartments, and (c) a combination thereof.

11. A hybrid framing system as in claim 8, further comprising two liquid-tight longitudinal bulkheads extending between each successive pair of transverse bulkheads and positioned symmetrically about said vessel centerline wherein a plurality of central, port and starboard cargo compartments are formed, each of said central cargo compartments having a width equal to W and each of said port and starboard cargo compartments having widths equal to between W/2 and W, and wherein each web frame is attached and positioned in an arrangement chosen from the group consisting of (a) said web frame being attached to and located between said inner hull shell and said outer hull shell, (b) said web frame being attached to and projecting into said cargo space from said inner hull shell of at least one of said bottom section, said port side wall section, said starboard side wall section, and said longitudinal bulkhead in said port and starboard cargo compartments, (c) said web frame being attached to and projecting into said cargo space from at least one of said bottom section and said longitudinal bulkheads in said central cargo compartment, and (d) a combination thereof.

12. A modular system for providing a predetermined arrangement of cargo compartments in a double hull bulk carrier vessel, the vessel having a longitudinal midsection for locating said cargo compartments, said system comprising:

a plurality of adjoining structural modules, each of said structural modules including a hull module and a transverse support member grouping for providing structural support to said hull module, said structural modules connected in series for forming a plurality of longitudinally adjacent liquid-tight cargo compartments;

each of said hull modules comprising:

port and starboard double hull side walls having upper and lower ends, a double hull bottom depending from said lower ends of said side walls, and a deck structure depending from said upper ends of said side walls, said side walls and said bottom each including an inner shell, an outer shell, and a plurality of longitudinal support members therebetween, said hull module having forward and aft longitudinally spaced ends; and each of said transverse support member groupings comprising individual support members including:

a liquid-tight transverse bulkhead, said transverse bulkhead attached to said side walls, said bottom and said deck structure at said forward ends and defining a cargo space therein, and at least one non-liquid-tight transverse web frame, said at least one web frame positioned between said transverse bulkhead and said aft end.

13. A modular system as in claim 12, wherein each of said structural modules further comprises at least one liquid-tight longitudinal bulkhead attached to said transverse bulkhead and extending between said forward and aft ends, said at least one longitudinal bulkhead dividing each of said plurality of longitudinally adjacent liquid-tight cargo compartments into at least two laterally adjacent liquid-tight cargo compartments.

14. A modular system as in claim 12, wherein each of said structural modules has a longitudinal length in feet equal to $x_1L$ wherein L is less than about 55 feet and $x_1$ is an integer between 1 and 5 the value of which may vary among structural modules, said individual support members in each said transverse support member grouping are separated by a distance in feet equal to L, and said plurality of adjoining structural modules when connected in series has a total longitudinal length in feet equal to $x_2L$ and wherein $x_2$ is an integer less than or equal to 20.

15. A modular system as in claim 13, wherein each of said at least one web frames is attached to a corresponding one of said hull modules and positioned with respect to said corresponding hull module in an arrangement chosen from the group consisting of (a) said web frame being attached to and located between said inner shell and said outer shell, (b) said web frame being attached to and projecting into said cargo space from at least one of said double hull bottom, said port double hull side wall, said starboard double hull side wall, said deck structure, and at least one of said at least one longitudinal bulkheads, and (c) a combination thereof.

* * * * *